US005915995A

United States Patent [19]

Meyer et al.

[11] Patent Number: 5,915,995

[45] Date of Patent: Jun. 29, 1999

[54] DUAL CONTACT BANANA CONNECTOR

[75] Inventors: Daniel B. Meyer, Lake Oswego; Clifford E. Baker, Hillsboro, both of Oreg.

[73] Assignee: Tektronix, Inc., Wilsonville, Oreg.

[21] Appl. No.: 08/988,500

[22] Filed: Dec. 10, 1997

[51] Int. Cl.[6] ..... H01R 17/18

[52] U.S. Cl. ..... 439/668; 439/585

[58] Field of Search ..... 439/668, 825, 439/660, 585, 172, 169, 527, 502, 101, 188, 669

[56] References Cited

U.S. PATENT DOCUMENTS

| | | | |
|---|---|---|---|
| 4,325,599 | 4/1982 | Feldman | 339/103 R |
| 4,988,315 | 1/1991 | Whaton | 439/668 |
| 5,022,872 | 6/1991 | Shichida | 439/668 |
| 5,147,221 | 9/1992 | Cull et al. | 439/585 |
| 5,230,641 | 7/1993 | Wharton | 439/668 |
| 5,704,812 | 1/1998 | Moji | 439/668 |

FOREIGN PATENT DOCUMENTS

| | | | |
|---|---|---|---|
| 1510-031-A | 9/1989 | U.S.S.R. | 439/668 |
| WO 93/08623 | 4/1993 | WIPO | 439/668 |

*Primary Examiner*—Steven L. Stephan
*Assistant Examiner*—Michael C. Zarroli
*Attorney, Agent, or Firm*—Bennet K. Langlotz; William K. Bucher

[57] ABSTRACT

An electrical connector with a female portion defining a bore having an aperture, and a male portion having an elongated member sized to be received in the bore. The female portion has a first flexible contact and an electrically isolated second rigid contact. The male portion has a first flexible contact and an electrically isolated second rigid contact. The connector may be a banana connector with a barrel spring providing conventional contact, and a separate contact at the tip of the male portion.

5 Claims, 3 Drawing Sheets

DUAL CONTACT BANANA CONNECTOR

FIELD OF THE INVENTION

The invention relates to electrical connectors, and more particularly to connectors having multiple independent contacts on a single connector.

BACKGROUND AND SUMMARY OF THE INVENTION

Electrical connectors are used for interconnecting electronic instruments or components. A typical connector is a banana lead having a single wire terminated at each end with a male banana plug. The banana plug has an elongated conductive probe portion wrapped with barrel spring, so that the probe portion may be inserted into a female receptacle in an instrument, with a conductive sleeve in the receptacle making contact with the barrel spring. Many other connector types have multiple lines, with multiple contacts on each end of a lead. Others have shielded configurations that have a signal wire wrapped by a shield wire, and coaxial end connectors to maintain shielding at the connections.

Instruments generally have limited area available for connector receptacles on exposed face plates. It is often desirable for an instrument to accept different connectors for different purposes. However, the different connector configurations require different types of connector receptacles, which increases the number of receptacles needed for versatility. For instance, a set of single receptacles may be needed in addition to a set of multiple-line connector receptacles. Lacking compatibility, an increased number of receptacles, and therefore an increased panel area must be provided.

The embodiments disclosed herein overcome these limitations by providing an electrical connector with a female portion defining a bore having an aperture, and a male portion having an elongated member sized to be received in the bore. The female portion has a first flexible contact and an electrically isolated second rigid contact. The male portion has a first flexible contact and an electrically isolated second rigid contact. The connector may be a banana connector with a barrel spring providing conventional contact, and a separate contact at the tip of the male portion.

DETAILED DESCRIPTION OF A PREFERRED EMBODIMENT

Figure 1:
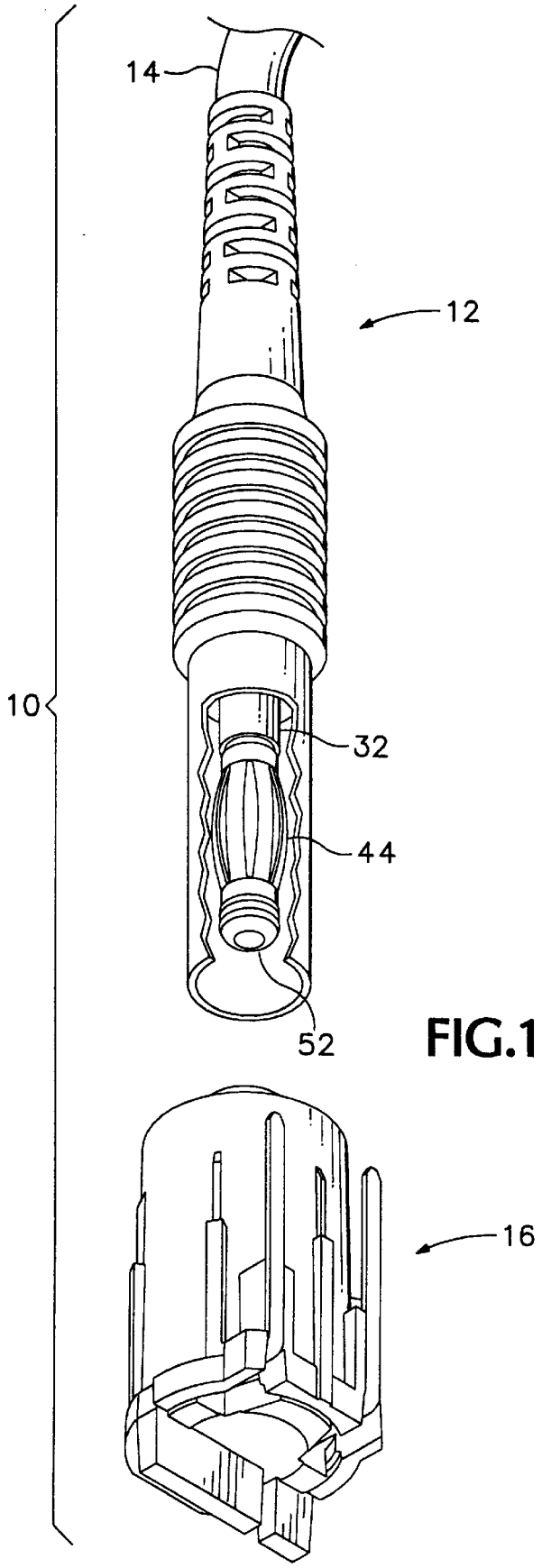
FIG. 1 is a perspective view of a connector pair according to a preferred embodiment of the invention.

FIG. 1 shows a split or dual banana connector pair 10 having a male portion or plug 12 connected to a lead 14, and a female portion or receptacle 16 for connection to an instrument panel, chassis, or printed circuit board, as will be discussed below. The lead connects to a probe (not shown) that contacts a device being tested by the instrument in which the female receptacle is mounted.

Figure 2:
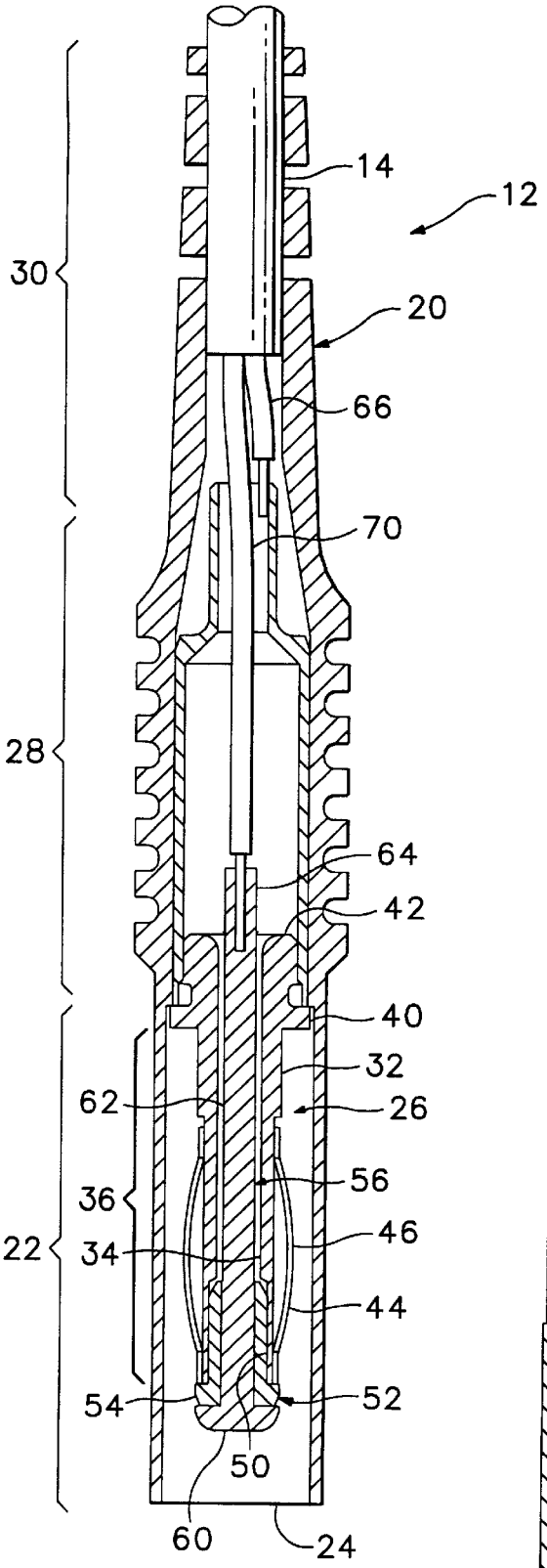
FIG. 2 is a sectional side view of a male element of the connector pair of FIG. 1.

FIG. 2 shows the male plug in greater detail. The plug has a plastic insulative housing 20 that has an elongated tubular shape in several sections. A shroud section 22 terminates at a free end 24 of the plug. The shroud is a thin walled cylinder that protects an elongated conductive plug element 26 coaxially received therein. A grip section 28 of the housing has a textured or ribbed outer surface, and a strain relief portion 30 defines perforations to permit flexure, and provides a passage for the lead 14.

The plug element 26 includes an elongated metal body 32 defining a bore 34. A cylindrical portion 36 of the body extends from a flange portion 40 toward the free end 24 of the plug. The flange rests against a shoulder in the plug housing bore, and has a butt portion 42 extending partly into the grip section 28. A barrel spring 44 is closely received on the cylindrical portion 36, and has elongated spring elements 46 that are positioned against the surface of the cylindrical portion at their ends, and which curve slightly so as to bulge outward at their midsections, in the manner of a conventional barrel spring on a banana plug.

The plug body bore 34 includes an enlarged end bore portion 50 near the free end. The end bore portion receives a plastic sleeve 52 defining a bore smaller than, and coaxial with the body bore 34. The sleeve has an enlarged rim 54 that limits insertion of the sleeve into the bore, and which has an outside diameter larger than the end portion of the metal body 32.

A rigid conductive nail 56 having an enlarged head 60 and an elongated shank 62 is received in the bore 34. The shank extends fully through the bore, with a protruding portion 64 extending beyond the end of the butt portion 42 of the body within the grip portion of the housing. The head portion of the nail rests against the rim 54 of sleeve 52, and has a diameter approximately equal to the rim diameter, a length less than half its diameter, and quarter-radius ed peripheral edges. The nail may have an insulative coating on the shaft to prevent electrical contact with the plug body bore near the protruding end. The free end of the nail is recessed from the free end 24 of the housing, so that contact by a fingertip is prevented.

Lead wire 14 has two conductive wires 66, 70. Wire 66 is electrically connected to a conductive shroud that fills and rigidly supports the grip section of the flexible plug housing, and which is crimped about the butt portion 42 of the conductive plug body. Wire 70 is connected to the protruding end 64 of the nail 56.

Figure 3:
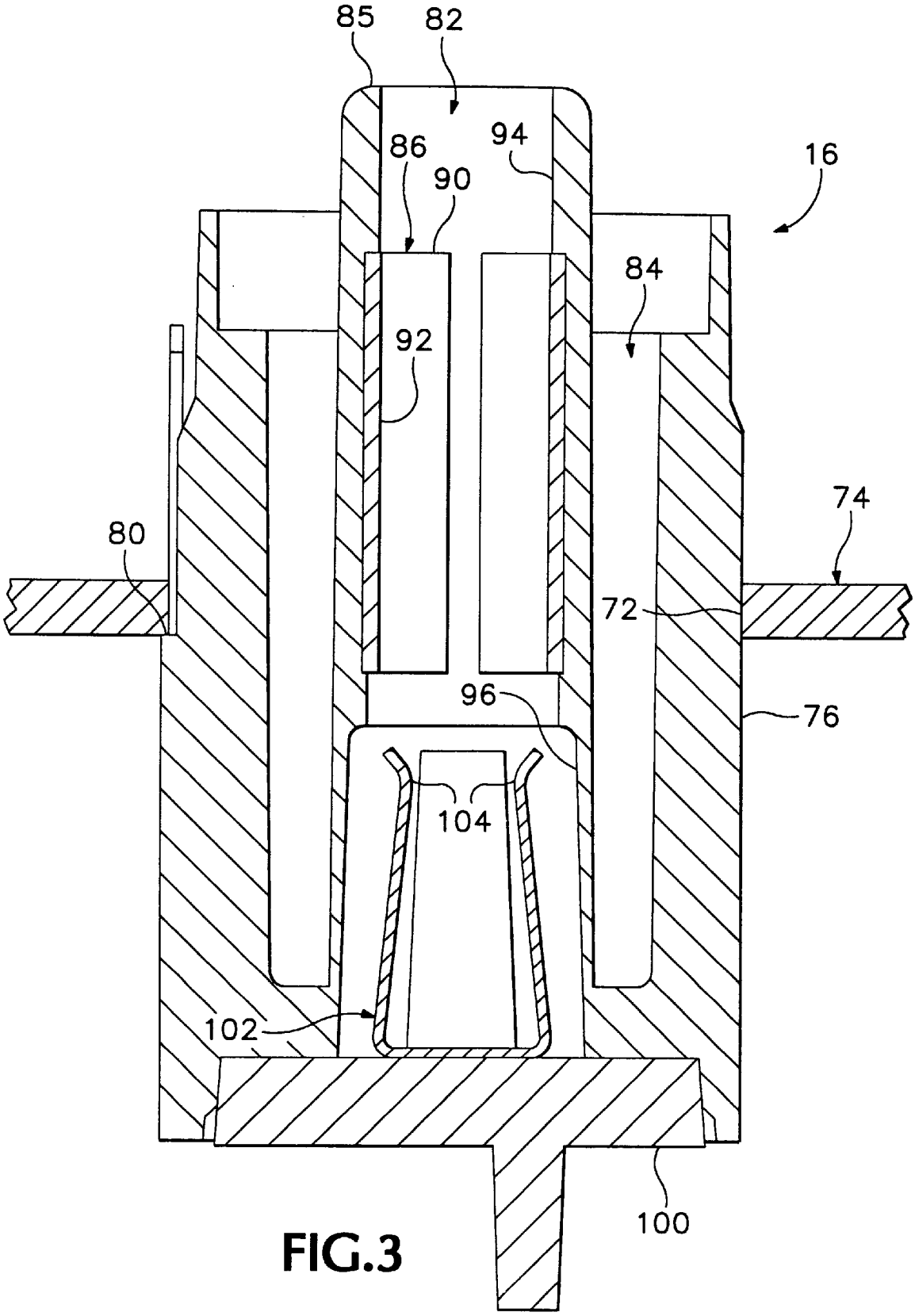
FIG. 3 is a sectional side view of a female element of the connector pair of FIG. 1.

FIG. 3 shows the female receptacle portion 16 mounted in a hole 72 of a printed circuit board 74 of an instrument. The receptacle is a stout cylindrical body formed of rigid insulative plastic, and having cylindrical exterior surface 76 having several ribs running partially along the length, and terminating at shoulders 80, which are positioned against the board surface. The receptacle defines a central bore 82 and an annular bore 84 coaxial with the central bore and extending nearly the full length of the receptacle. A cylindrical protrusion having a free end 85 defines bore 82, and is surrounded by bore 84.

Two independent electrical contacts reside in the receptacle bore. A rigid conductive sleeve contact 86 is closely received by a major portion of the bore, and has a sleeve end 90 positioned against a shoulder in the bore. The sleeve defines a sleeve bore 92 having a diameter slightly less than that of an end portion 94 of the receptacle bore. The sleeve extends a substantial depth into the bore, so that a standard male banana connector makes contact when inserted.

The receptacle bore includes an enlarged chamber 96 at its deepest portion. The chamber is enclosed at its base by a cover plate 100 that is absent during installation of the sleeve, then installed and secured to enclose the bore. A flexible conductive spring 102 is mounted to the interior surface of the cover 100. The spring has a flat base mounted to the cover, and a pair of opposed arms extending upward from the base. The spring arms are nearly parallel leaf springs, slanting slightly toward each other. At their free ends, the springs are curved away from each other to facilitate smooth insertion of a plug element between the arms. The spring arms are straight until the end flares, and the point of inflection 104 approximately forms the narrowest spacing between the spring arms when at rest. Each of the sleeve contact 86 and the spring contact 102 is electrically connected to the board 74 or to other electrical circuitry in the instrument.

Figure 4:
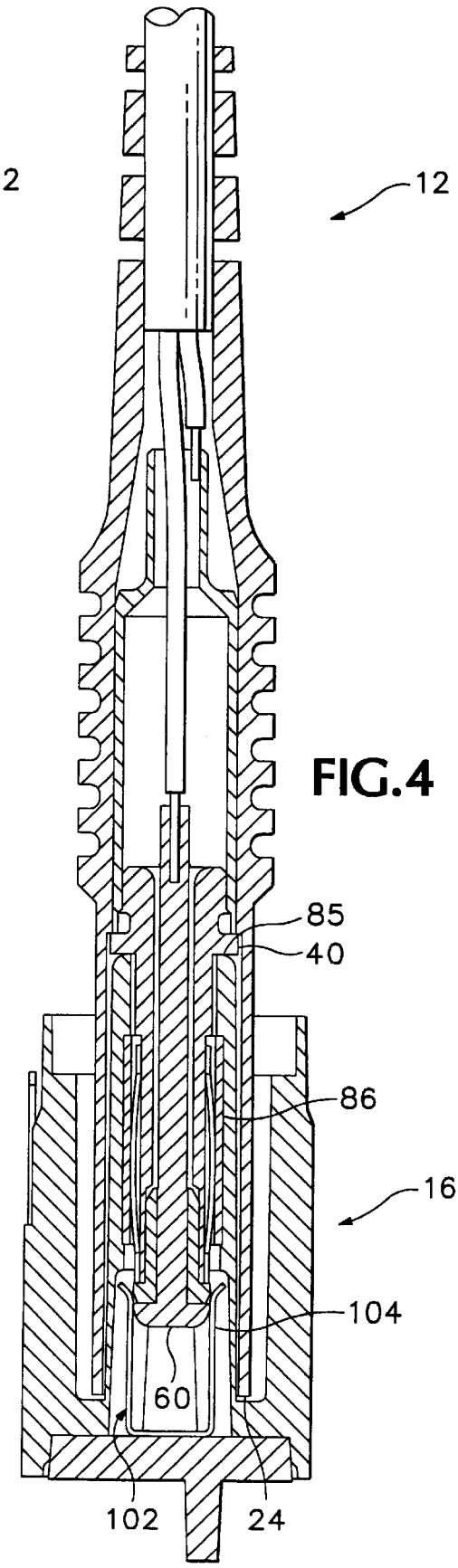
FIG. 4 is a sectional side view of the connector pair of FIG. 1 in a mated condition.

FIG. 4 shows the male and female sections of the plugs mated for electrical connection of each of the lead lines to the instrument. Fully mated, the free end 85 of the receptacle protrusion rests against the shoulder 40 of the plug body. The shroud 22 is received in the annular bore 84. The plug body 32 is fully inserted into the central bore, with the widest portions of the barrel spring elements aligned with an intermediate position of the sleeve 86. The free ends of the spring arms 102 extend to a distance aligned with the end of the plug body; due to the outward flare of the free ends, contact between the spring and the body is avoided. As the diameter of the nail head 60 is approximately equal to the length of the spring base, insertion of the head between the spring arm ends to a depth slightly beyond the inflection points 104 spreads apart the arms to a parallel configuration. This further flares spring free ends away from the plug body, and ensures contact with the nail head instead of with the plug sleeve 52. The contact with the barrel spring provides a high current capacity main contact, which the contact with the nail head is well suited to a lower current signal or logic line.

In the preferred embodiment, the dimensions of many of the connector elements are compatible with or the same as those of a conventional standard banana plug connector according to military specification A-A-55468; the plug's nail head contact and the associated receptacle spring 102 are departures from the standard connector. In the preferred embodiment, the cylindrical portion 36 of the plug body 32 has a length of 0.730 inch, a minimum barrel-spring-compressed diameter of 0.160 inch, a maximum diameter about the uncompressed barrel springs of 0.180 inch, with the widest spring point spaced 0.413 inch from the shoulder 40. The barrel spring has a length of 0.475 inch, so that it is spaced apart from the shoulder by 0.170 inch. To provide room for the insulative sleeve and the nail head contact in the preferred embodiment's standard length, the cylindrical portion 36 of the plug body extends only to 0.645 inch from the shoulder, with the sleeve rim adding another 0.040 inch, and the nail head adding a final 0.045 inch.

The nail head has a diameter of 0.150 inch, and the sleeve rim has a flange diameter of 0.145 inch. In the receptacle, the sleeve 86 has a length of 0.410 inch, and is spaced apart from the free end 85 of the receptacle by 0.160 inch. The sleeve has an inside diameter of 0.160 inch.

By using the standard banana plug specifications, either portion of the disclosed connector may be used as or in conjunction with a standard single plug banana plug or receptacle. The second nail head/receptacle spring contacts may be idle while the primary barrel spring/sleeve contact is used. Thus, a single receptacle on an instrument panel may serve as a two line or split connection, as might be used for a thermocouple or shielded signal lead, while also serving as a receptacle for a conventional banana lead for other purposes. This versatility reduces the number of receptacles required for a given number of dual and single connections.

While the disclosure is made in terms of a preferred embodiment, the invention is not intended to be so limited.

We claim:

1. An electrical connector comprising:

a female portion defining a bore having an aperture;

a male portion having an elongated member sized to be received in the bore and having a free end;

the male portion having an elongated electrically conductive body defining a bore with a free end and having a first flexible barrel spring contact on the body and an insulating sleeve having a bore therein that is disposed in the free end of the elongated electrically conductive body bore that receives a second rigid electrical contact extending within the bore of the elongated electrically conductive body and forms a separate contact at the free end tip of the male portion; and the female portion having a first flexible contact and an electrically isolated second rigid sleeve contact sized to receive the barrel spring.

2. The connector of claim 1 wherein the rigid contact of the male portion is at the free end of the elongated member.

3. The connector of claim 2 wherein the flexible contact of the female portion is a spring positioned in the bore at a greater depth than the depth at which the female rigid contact is positioned, such that the male rigid contact contacts only the female flexible contact.

4. The connector of claim 1 wherein the female portion flexible contact includes a leaf spring.

5. The connector of claim 1 wherein the female portion rigid contact is closer to the female portion flexible contact than to the aperture of the bore.

* * * * *